US006360509B1

(12) United States Patent
Sluiter

(10) Patent No.: US 6,360,509 B1
(45) Date of Patent: Mar. 26, 2002

(54) METAL BUILDING TRUSS AND METHOD OF CONSTRUCTION

(76) Inventor: Scott E. Sluiter, 4900 168th Ave., Holland, MI (US) 49424

( * ) Notice: Subject to any disclaimer, the term of this patent is extended or adjusted under 35 U.S.C. 154(b) by 0 days.

(21) Appl. No.: 09/494,691

(22) Filed: Jan. 31, 2000

(51) Int. Cl.[7] ..... E04B 1/18

(52) U.S. Cl. ..... 52/634; 52/641; 52/644; 52/897.31; 52/738

(58) Field of Search ..... 52/86, 88, 690, 52/691, 693, 644, 716.8, 717.03, 717.06, 745.13, 85, 639

(56) References Cited

U.S. PATENT DOCUMENTS 4,253,210 A 3/1981 Racicot
4,393,637 A * 7/1983 Mosier ..... 52/644
4,435,940 A * 3/1984 Davenport et al. ..... 52/641
5,417,028 A * 5/1995 Meyer ..... 52/738
5,444,913 A * 8/1995 Nyitray ..... 29/897.31
5,463,837 A 11/1995 Dry

* cited by examiner

*Primary Examiner*—Carl D. Friedman
*Assistant Examiner*—Steve Varner
(74) *Attorney, Agent, or Firm*—Price, Heneveld, Cooper, DeWitt & Litton

(57) ABSTRACT

A truss for supporting a roof of a building and the like includes a bottom chord member having a first end and a second end, and a top chord member fixedly attached to the bottom chord member and having arcuately curved upper surface. The upper surface is flanked by a pair of spaced leg members, which are corrugated to provide the upper surface with a generally smooth arcuate shape. In one aspect of the present invention this upper surface and depending leg members essentially comprise the top chord, while in another aspect of the invention, the upper surface and corrugated legs comprise an upper truss cap which sits over a conventional segmented chord. In addition, the same techniques can also be employed to provide a bottom chord with an arcuately curved lower surface.

48 Claims, 3 Drawing Sheets

METAL BUILDING TRUSS AND METHOD OF CONSTRUCTION

BACKGROUND OF THE INVENTION

The present invention relates to building trusses, and in particular to an arcuately shaped truss assembly for supporting the roof of a building and the like.

Open web structural supports in general, and in particular, structural trusses are used for the fabrication of buildings in the construction industry. While open web supports are used to form a variety of building structural segments, the primary application of the structural trusses is to define a desired roofline and to support the roof by the building walls and interior structure. Trusses are typically fashioned from a series of joined vertical, horizontal, and angled members. Historically, trusses have been fabricated from wooden members joined by flat metal plates having a plurality of spiked projections therefrom for driving the plates into the wooden members and retaining the members in a joined relationship.

In recent years, metal trusses and metal open web structural supports have gained favor in the construction industry. Metal supports are typically comprised of a plurality of U-shaped channels and square tubular members with the members being joined by mechanical fasteners.

Many building designs include curved roofs that define an arcuately shaped roofline. The curved construction of these roofs and the trusses associated therewith make them particularly strong with respect to forces being applied to the outer surfaces of the roof. The upper chord member associated with these "curved trusses" are typically provided in the form of a plurality of substantially straight segments that are connected to one another in an end-to-end fashion to approximate a smooth arcuate structure.

As a result of the upper chords being constructed of a plurality of straight segments, the truss ties extending between the trusses and providing lateral support must be customized with respect to thickness and placement along the tops of the top chords so as to provide a smooth arcuate surface for attaching the associated curved roof components to. The vertical height or thickness as well as the attachment points of the truss ties are typically determined by individually measuring the proper spacing along each individual segment of the segmented top chord, thereby insuring proper alignment. Such a process is time consuming and adds to the construction time and cost during the construction of the building.

There is a need for a truss assembly which is easy to install, reduces construction time, and allows for substantially random placing of the truss ties along the top surface of the associated trusses.

SUMMARY OF THE INVENTION

The roof support truss of the present invention includes a top chord with an arcuately curved upper surface, rather than a plurality of flat segment surfaces. The upper surface is flanked by a pair of downwardly depending, spaced leg members, which are corrugated to provide the upper surface with a generally smooth arcuate shape. In one aspect of the invention, this upper surface and depending leg members essentially comprise the top chord, while in another aspect of the invention, the upper surface and corrugated legs comprise an upper truss cap which sits over a conventional segmented chord. In addition, the same techniques can also be employed to provide a bottom chord with an arcuately curved lower surface.

The truss system of this invention provides effectively reduces the cost and time associated with the construction of roofs having an arcuately shaped roofline and/or arcuately shaped ceiling. These and other advantages of the invention will be further understood and appreciated by those skilled in the art by reference to the following written specification, claims and appended drawings.

DETAILED DESCRIPTION OF PREFERRED EMBODIMENT

Figure 1:
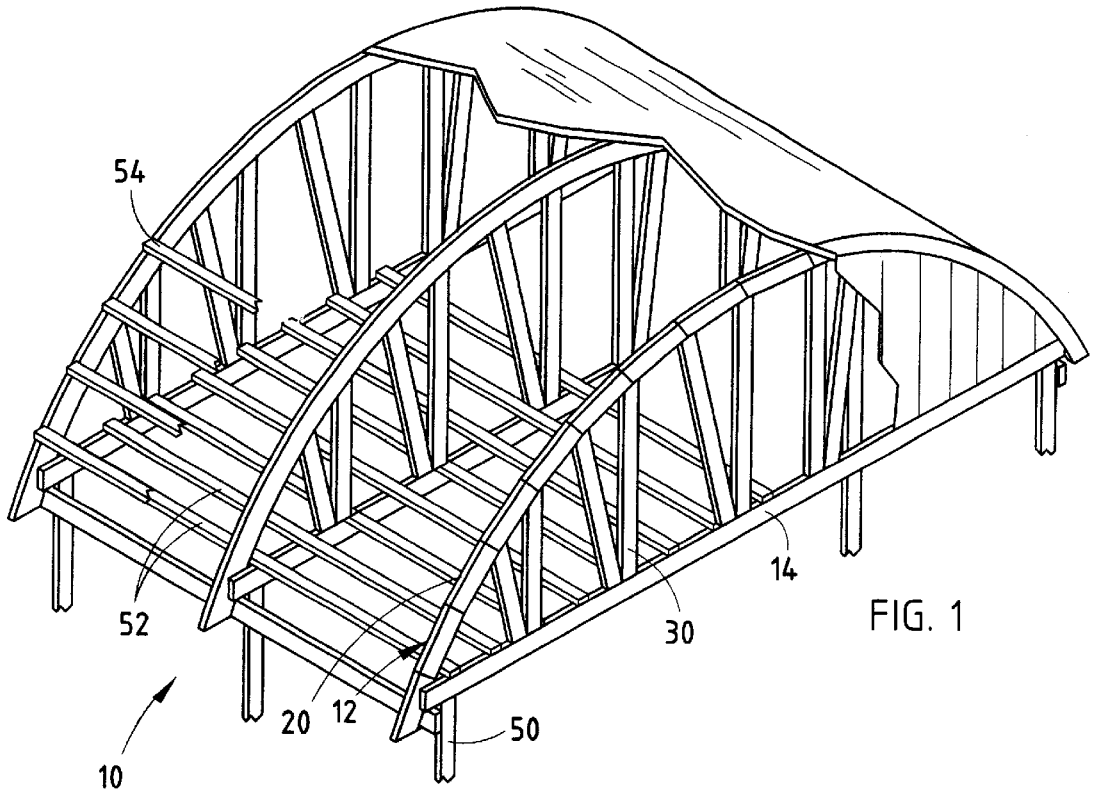
FIG. 1 is a perspective view of a plurality of roof trusses embodying the present invention.

For purposes of description herein, the terms "upper," "lower," "right," "left," "rear," "front," "vertical," "horizontal," and derivatives thereof shall relate to the invention as oriented in FIG. 1. However, it should be understood that the invention may assume various alternative orientations and step sequences, except where expressly specified to the contrary. It should also be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly stated otherwise.

Figure 2:
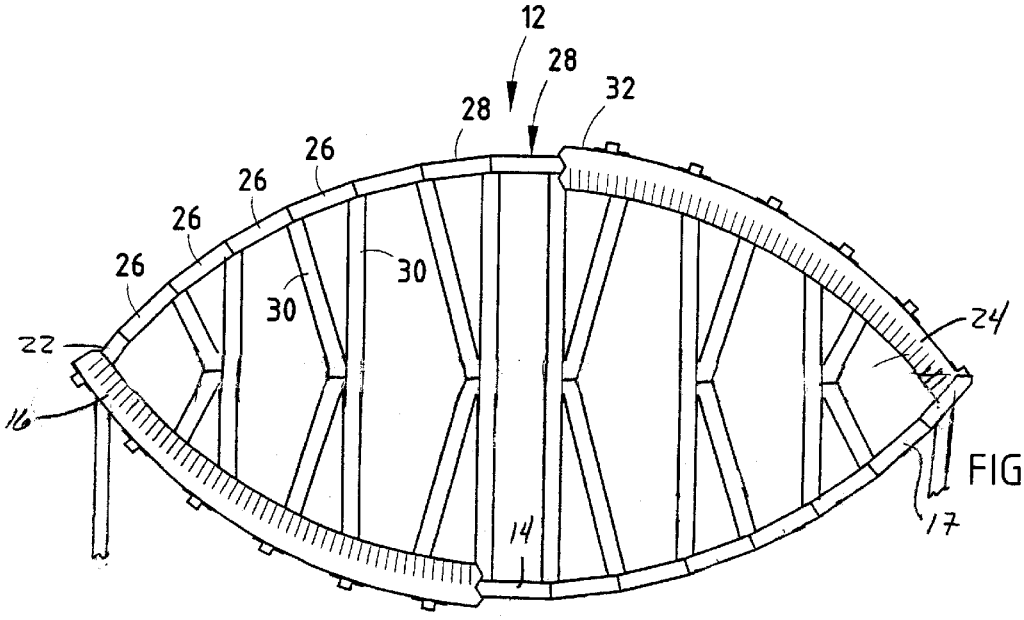
FIG. 2 is a front elevational view of a single truss with a portion of a truss caps broken away to reveal internal construction.
Figure 5:
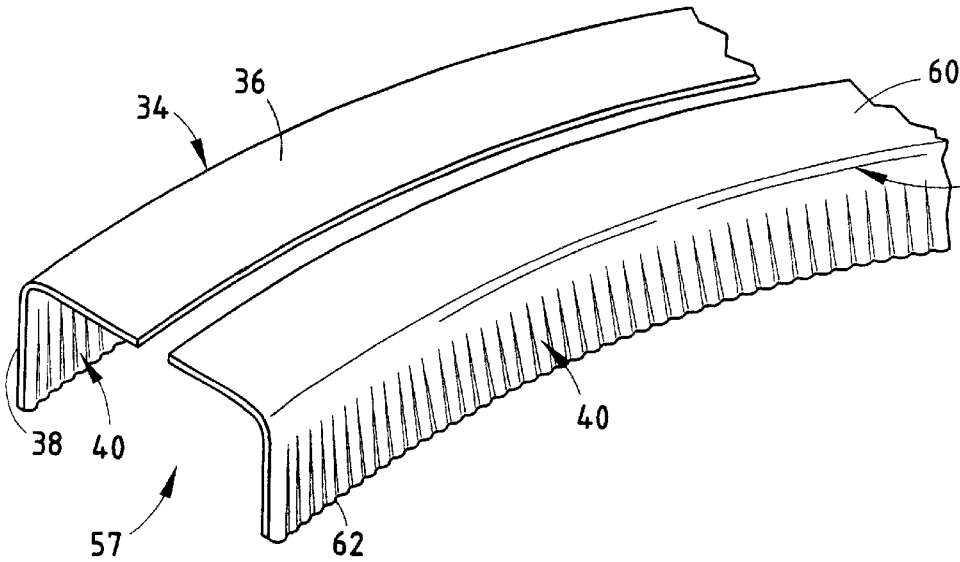
FIG. 5 is a perspective view of a truss cap including a first member and a second member.

The reference numeral 10 (FIG. 1) generally designates a truss system embodying the present invention. In the illustrated example, the truss system is adapted to support the roof and/or an interior ceiling of a building and the like. The truss system 10 includes a plurality of individual trusses 12. Each individual truss 12 (FIG. 2) includes a bottom chord member 14 having a first end 16 and a second end 17, and a top chord member 20 having a first end 22 fixedly attached to first end 16 of bottom chord member 14, and a second end 24 fixedly attached to second end 18 of bottom chord member 14. Top chord member 20 includes a plurality of intermediate members 26 connected in an end-to-end fashion to define a top edge 28 of top chord member 20. The intermediate members 26 are arranged to provide top edge 28 of top chord member 20 a segmented, generally arcuate shape. It should be noted that the bottom chord member 14 may also be constructed similarly to the arcuately shaped top chord member 20 as shown in FIG. 2, however, the description of the possible embodiments of the upper chord member 20 should be considered descriptive of both. Each truss 12 further includes a plurality of web members 30 which extend between bottom chord member 14 and top cord member 20 and are fixedly attached thereto, thereby providing structural support to truss 12. Truss 12 further includes a truss cap 32 that includes a first L-shaped member 34 (FIG. 5) having a top section 36 and at least one leg section 38 which is corrugated to provide top section 36 of first member 34 with a generally smooth arcuate shape similar in radius to the segmented, generally arcuate shape of top chord member 20.

Bottom chord member 14, top chord member 20 and intermediate members 26 are typically provided in the form of C-shaped channels or square shaped tubes, however, these members may be provided with other geometrical cross-sectional shapes. Bottom chord member 14, top chord member 20 and intermediate members 26 are typically formed from thin gauged sheets of metal such as steel, however, other metals can be used in the construction thereof. Further, other materials such as wood, polymeric materials and/or composite materials may also be used to conduct the structural components of truss 12. Bottom chord member 14, top chord member 20 and intermediate members 26 are fixedly attached to one another by means of welding such as spot welding and/or mechanical fasteners. However, other forms of connection may be used depending on the materials used to construct the structural components of truss 12.

Figure 6:
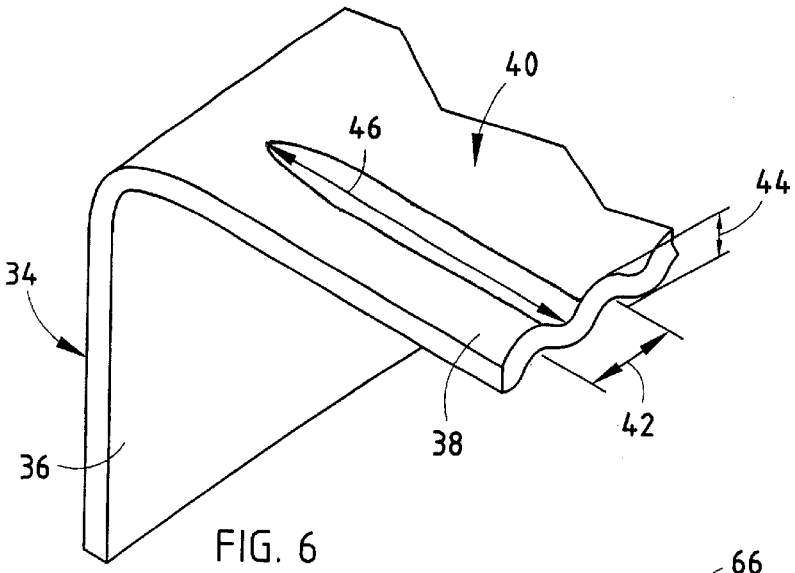
FIG. 6 is an enlarged view of the corrugated section of the truss cap.

Truss cap 32 (FIG. 5) is constructed of a thin gage steel. In the illustrated example, a twenty gage sheet thickness was used, however, other thicknesses and materials can be used. Truss cap 32 is provided in the form of a flat sheet, which is then crimped to form an L-shaped bracket having top section 36 and leg section 38. Leg section 38 is then corrugated to provide a plurality of corrugations 40. Each corrugation 40 (FIG. 6) defines a frequency 42 and an amplitude 44. Each corrugation is also provided to a lateral depth 46 along leg section 38.

The radius as defined by the arc of truss cap 32 can be controlled by adjusting frequency 42, amplitude 44, and/or depth 46 of corrugations 40, thereby allowing truss cap 32 to be sized for a particular application. More specifically, increasing frequency 42 of corrugations 40 while maintaining amplitude 44 and depth 46 will decrease the radius of the arc defined by truss cap 32. Conversely, decreasing frequency 42 of corrugations 40 along leg section 38 while holding amplitude 44 and depth 46 constant increases the radius as defined by truss cap 32. Similarly, increasing amplitude 44 of corrugations 40 while holding frequency 42 and depth 46 constant decreases the radius as defined by the arc of truss cap 32. Finally, increasing the lateral depth 46 of corrugations 40 into leg section 38 reduces the radius as defined by truss cap 32. It should be noted that frequency 42, amplitude 44 and lateral depth 46 may all be adjusted simultaneously to provide a particular radius as defined by the arc of truss cap 32. Further, frequency 42, amplitude 44 and/or lateral depth 46 may be varied during the corrugation of truss cap 32, thereby providing a multitude of radiuses and providing a roofline along which the arc defined thereby varies. The corrugation process can be provided at a truss manufacturing facility or on site as the building structure is constructed.

Figure 3:
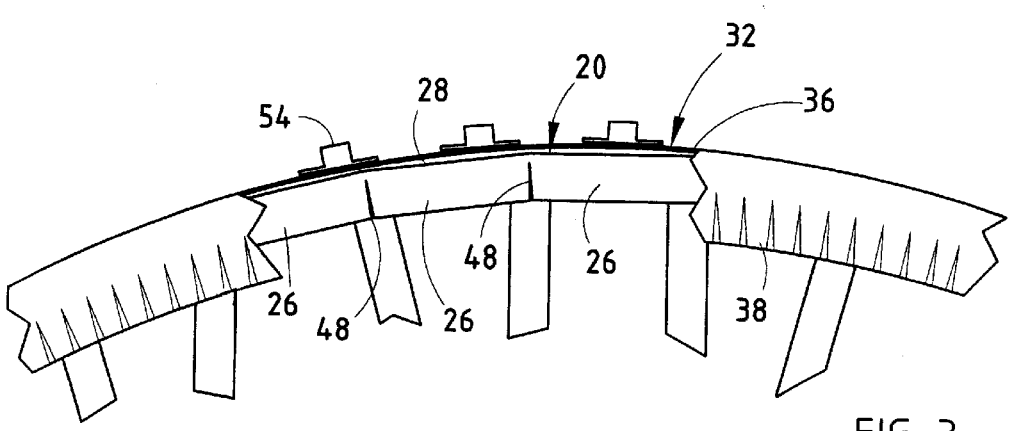
FIG. 3 is an enlarged view of the front elevational view shown in FIG. 2, including a plurality of hat-shaped truss ties.

In assembly, truss cap 32 is placed over top chord member 20 such that top section 36 of truss cap 32 is placed directly over top edge 28 of top chord member 20. Truss cap 32 is fixedly attached to top chord member 20 by means of welding and/or mechanical fasteners depending on the materials from which the relative components are constructed. As best illustrated in FIG. 3, truss cap 32 is supported above top chord member 20 at a plurality of connection points 48 as defined by the end-to-end connections of intermediate members 26. Truss cap 32 is also supported above top chord member 20 by way of the welds and/or fasteners as discussed above.

As shown in FIG. 1, trusses 12 are placed above and structurally supported by a building structure 50. Trusses 12 are each interconnected by way of a plurality of lower cross-braces 52 that are fixedly attached to bottom chord members 14, and a plurality of tie members 54 that interconnect trusses 12 and are fixedly attached to top section 36 of truss caps 32 (FIG. 3). Tie members 54, as illustrated, are provided with a hat-shaped cross-sectional geometry, however, any suitable geometrical cross-sectional shape providing a constant distance between the top section 36 of truss cap 32 and the top of each tie member 54 may be used. The generally smooth arcuate shape and substantially constant radius as defined by truss cap 32 makes it possible to use tie members 54 that have a relatively similar height.

Figure 4:
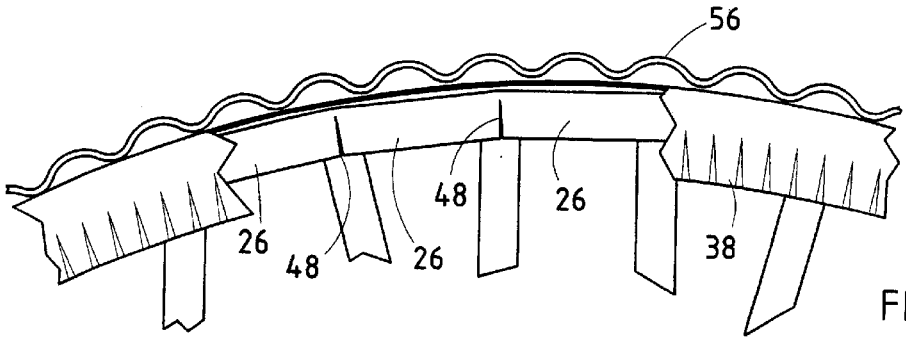
FIG. 4 is an enlarged front elevational view of the truss including a corrugated sheet truss tie.

In an alternative embodiment, as illustrated in FIG. 4, a sheet of corrugated metal 56 can be used as an effective tie member. Metal sheet 56 can be provided as a single sheet or in the form of a plurality of overlapping sheets. Metal sheet 56 reduces the cost associated with the placement and attachment of individual tie members 54 along top section 36 of truss caps 32, while still providing the required structural rigidity.

In another alternative embodiment, a truss cap 57 includes the first L-shaped member 34 and a second L-shaped member 58 having a second top section 60 and a second leg section 62 extending substantially perpendicular to second top section 60. Second leg section 62 is corrugated similarly to leg section 38 of first member 34 such that second member 58 has a substantially similar radius to first member 34.

In assembly, first member 34 and second member 58 are mated together such that second top section 60 of second member 58 is overlapped and covered by top section 36 of first member 34. First member 34 and second member 58 may be fixedly attached to one another by way of spot welding or mechanical fasteners depending on the materials used in the construction thereof. Truss cap 57 is fit over top chord member 20. The truss cap 57-provides an increase structural strength due to overlapping top section 36 of first member 34 and second top section 60 of second member 58, thereby allowing truss cap 57 to support an increased amount of weight thereon.

Figure 7:
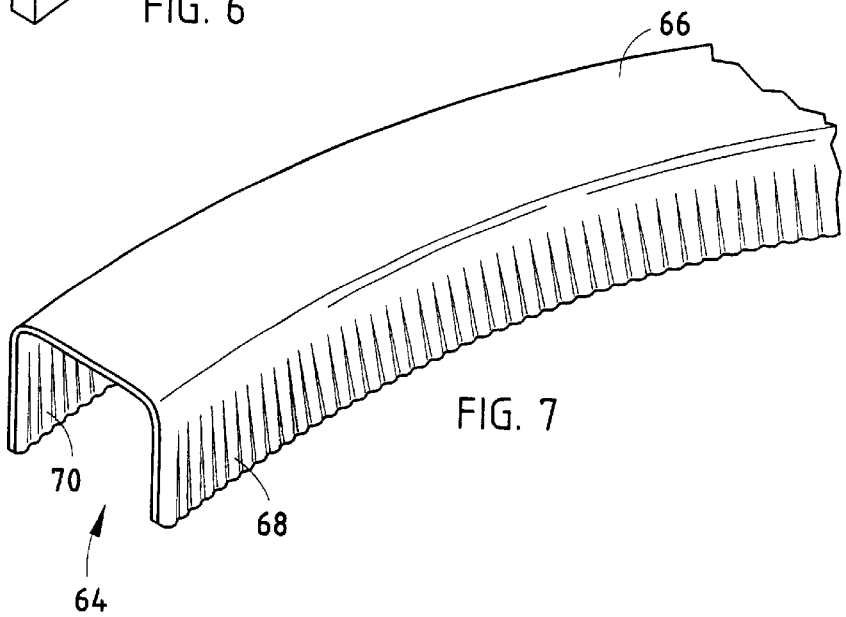
FIG. 7 is a perspective view of an alternative embodiment truss cap.

In yet another alternative embodiment, as illustrated in FIG. 7, an inverted U-shaped truss cap 64 includes a top section 66, a first leg section 68 and a second leg section 70. First and second leg sections 68 and 70 are juxtaposed across top section 66 and extend substantially perpendicular therefrom, thereby forming a substantially U-shaped channel. First and second leg section 68 and 70 are each laterally corrugated similar to leg section 38 (FIG. 5) of first member 34, thereby providing top section 66 with a generally smooth arcuate shape similar in radius to the segmented, generally arcuate shape of top chord member 20. Truss cap 64 is used similarly to truss cap 57.

Figure 8:
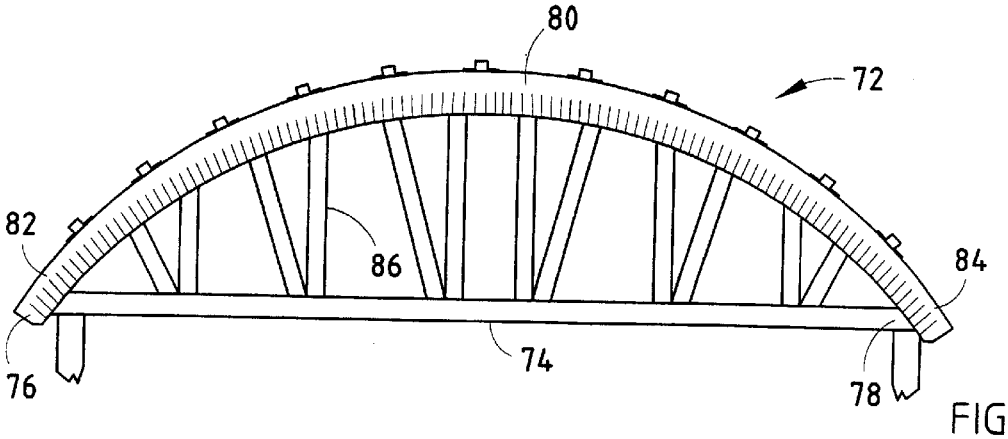
FIG. 8 is a front elevational view of an alternative embodiment truss wherein the top chord member is arcuately shaped.

In another alternative embodiment, as illustrated in FIG. 8, a truss 72 includes a bottom chord member 74 having a first end 76 and a second end 78, and an inverted U-shaped top chord member 80 having a first end 82 fixedly attached to first end 76 of bottom chord member 76 and a second end 84 fixedly attached to second end 78 of bottom chord member 74. A plurality of web members 86 extend between bottom chord member 74 and top chord member 80 and are fixedly attached thereto, thereby providing structural rigidity to truss 72. In the illustrated example, top chord member 80 is similar in construction to the inverted U-shaped truss cap 64 (FIG. 7). In the illustrated embodiment, truss 72 is used in place of the top chord 20 (FIG. 2) and truss cap 32 assembly of truss 12, thereby reducing the cost of materials and labor associated with the construction and installation of individual components.

In yet another alternative embodiment, as best illustrated in FIG. 2, the bottom chord member 14 may be provided in a similarly segmented embodiment similar to that described with respect to top chord member 20, and then covered or encased by a truss cap similar to truss cap 32 associated with top chord member 20. The truss cap associated with bottom chord member 14 may also be provided in the form of a single L-shaped bracket, two L-shaped brackets, or a U-shaped channel similar to the truss cap 32 associated with top chord member 20. Further, the bottom chord member can itself be provided in the form of a U-shaped channel or two L-shaped brackets without the use of a truss cap, again similar to top chord member 20.

It should also be noted that the general technique and apparatus as described herein, may be used the cover and structurally reinforce other arcuately shaped building structures and components such as walls, doors, and partitions.

In the foregoing description, it will be readily appreciated by those skilled in the art that modifications maybe made to the invention without departing from the concepts disclosed herein. Such modification is to be considered as included in the following claims, unless these claims by their language expressly state otherwise.

The invention claimed is:

1. A truss for supporting the roof of a building and the like, comprising:

a bottom chord member;

a top chord member including a plurality of intermediate members connected in an end-to-end fashion to define a top edge of the top chord, the intermediate members arranged to provide the top edge of the top chord member a segmented generally arcuate shape;

a plurality of web members extending between the bottom chord member and the top chord member and fixedly attached thereto; and a first truss cap including a first member having a top section and at least one leg section extending generally perpendicular to the top section, the at least one leg section being corrugated to provide the top section with a generally smooth arcuate shape similar in radius to the segmented generally arcuate shape of the top chord member.

2. The truss described in claim 1, wherein the truss cap includes a first leg and a second leg juxtaposed across the top section, thereby forming an inverted, generally U-shaped channel.

3. The truss described in claim 2, wherein the truss cap is constructed of a lightweight metal.

4. The truss described in claim 3, wherein the bottom chord member, the top chord member and the web members are constructed of a lightweight metal.

5. The truss described in claim 3, wherein the bottom chord member, the top chord member and the web members are constructed of wood.

6. The truss described in claim 1, wherein the truss cap is constructed of a lightweight metal.

7. The truss described in claim 1, wherein the bottom chord member, the top chord member and the web members are constructed of a lightweight metal.

8. The truss described in claim 1, wherein the bottom chord member, the top chord member and the web members are constructed of wood.

9. The truss described in claim 1, wherein the truss cap also includes a second member having a second top section and a second leg section extending generally perpendicular to the second top section, the second leg section being laterally corrugated to provide the second top section with a generally smooth arcuate shape similar in radius to the segmented generally arcuate shape of the top chord, and wherein the first member of the truss cap has only one leg member, and wherein the first member mates with the second member to provide the truss cap with an inverted, generally U-shaped cross-section.

10. The truss described in claim 1, further including:

a second truss cap including a first member having a bottom section and at least one leg section extending generally perpendicular to the bottom section, and wherein the bottom chord member includes a plurality of intermediate members connected in an end-to-end fashion to define a bottom edge of the bottom chord, the intermediate members arranged to provide the bottom edge of the bottom chord member a segmented generally arcuate shape, and wherein the at least one leg section of the second truss cap is corrugated to provide the bottom section with a generally smooth arcuate shape similar in radius to the segmented generally arcuate shape of the bottom chord member.

11. The truss described in claim 10, wherein the second truss cap also includes a second member having a second bottom section and a leg section extending generally perpendicular to the second bottom section, the second leg section being laterally corrugated to provide the second bottom section with a generally smooth arcuate shape similar in radius to the segmented generally arcuate shape of the bottom chord, and wherein the first member of the second truss cap has only one leg member, and wherein the first member mates with the second member to provide the second truss cap with a generally U-shaped cross-section.

12. A truss for supporting the ceiling of a building and the like, comprising:

a bottom chord member including a plurality of intermediate members connected in an end-to-end fashion to define a bottom edge of the bottom chord, the intermediate members arranged to provide the bottom edge of the bottom chord member a segmented generally arcuate shape;

a top chord member;

a plurality of web members extending between the bottom chord member and the top chord member and fixedly attached thereto; and a first truss cap including a first member having a bottom section and at least one leg section extending generally perpendicular to the bottom, the at least one leg section being corrugated to provide the bottom section with a generally smooth arcuate shape similar in radius to the segmented generally arcuate shape of the bottom chord member.

13. The truss described in claim 12, wherein the first truss cap includes a first leg and a second leg juxtaposed across the top section, thereby forming a generally U-shaped channel.

14. The truss described in claim 13, wherein the first truss cap is constructed of a lightweight metal.

15. The truss described in claim 14, wherein the bottom chord member, the top chord member and the web members are constructed of a lightweight metal.

16. The truss described in claim 14, wherein the bottom chord member, the top chord member and the web members are constructed of wood.

17. The truss described in claim 12, wherein the first truss cap is constructed of a lightweight metal.

18. The truss described in claim 12, wherein the bottom chord member, the top chord member and the web members are constructed of a lightweight metal.

19. The truss described in claim 12, wherein the bottom chord member, the top chord member and the web members are constructed of wood.

20. The truss described in claim 12, wherein the first truss cap also includes a second member having a second bottom section and a second leg section extending generally perpendicular to the bottom section, the second leg section being laterally corrugated to provide the second bottom section with a generally smooth arcuate shape similar in radius to the segmented generally arcuate shape of the bottom chord, and wherein the first member of the first truss cap has only one leg member, and wherein the first member mates with the second member to provide the first truss cap with a generally U-shaped cross-section.

21. The truss described in claim 12, further including:

a second truss cap including a first member having a top section and at least one leg section extending generally perpendicular to the top surface, and wherein the top chord member includes a plurality of intermediate members connected in an end-to-end fashion to define a top edge of the top chord, the intermediate members arranged to provide the top edge of the top chord member a segmented generally arcuate shape, and wherein the at least on leg section is corrugated to provide the top section with a generally smooth arcuate shape similar in radius to the segmented generally arcuate shape of the top chord member.

22. The truss described in claim 21, wherein the second truss cap also includes a second member having a second top section and a second leg section extending generally perpendicular to the second top section, the second leg section being laterally corrugated to provide the second top section with a generally smooth arcuate shape similar in radius to the segmented generally arcuate shape of the top chord, and wherein the first member of the second truss cap has only one leg member, and wherein the first member of the second truss cap mates with the second member of the second truss cap to provide the second truss cap with an inverted, generally U-shaped cross-section.

23. A truss for supporting structured components of a building and the like, comprising:

a bottom chord member; and a top chord member; and wherein at least a selected one of the bottom chord member and the top chord member includes a first flat section and first and second leg sections juxtaposed across the flat section and extending generally perpendicular therefrom providing the top chord with a substantially inverted U-shaped cross-section, the first and second leg sections being laterally corrugated to provide the first flat section with a generally smooth arcuate shape for evenly supporting components of a building; and wherein the selected chord member includes a first L-shaped member that includes a first partial flat section and the first leg section, and a second L-shaped member that includes a second partial flat section and the second leg section, wherein the first and second L-shaped members are mateable such that first partial flat section and second partial top section form the flat section of the top chord member.

24. A truss assembly for supporting building structural components and the like, comprising:

a plurality of trusses that each include:

a bottom chord member;

a top chord member extending above the top chord member and fixedly attached thereto, the top chord member including a plurality of intermediate members connected in an end-to-end fashion to define a top edge of the top chord and arranged to provide the top edge of the top chord member a segmented generally arcuate shape; and a plurality of web members extending between the bottom chord member and the top chord member and fixedly attached thereto;

a first truss cap including a first member having a top section and at least one leg section extending generally perpendicular to the top section, the at least one leg section being corrugated to provide the top section with a generally smooth arcuate shape similar in radius to the segmented generally arcuate shape of the top chord member; and at least one upper tie member that extends between the plurality of trusses, and which is fixedly attached to the top section of the truss cap of each truss, wherein each upper tie member extends generally the same distance above the first truss cap.

25. The truss assembly described in claim 24, wherein the at least one upper tie member is a plurality of hat-shaped ties.

26. The truss assembly described in claim 24, wherein the at least one upper tie member is provided in the form of at least one sheet of corrugated material.

27. The truss assembly described in claim 24, wherein the first truss cap includes a first leg and a second leg juxtaposed across the top section, thereby forming an inverted, generally U-shaped channel.

28. The truss assembly described in claim 24, wherein the truss cap is constructed of a lightweight metal.

29. The truss assembly described in claim 24, wherein the first truss cap also includes a second member having a second top section and a second leg section extending generally perpendicular to the top section, the second leg section being laterally corrugated to provide the second top section with a generally smooth arcuate shape similar in radius to the segmented generally arcuate shape of the top chord, and wherein the first member of the first truss cap has only one leg member, and wherein the first member mates with the second member to provide the first truss cap with an inverted, generally U-shaped cross-section.

30. The truss assembly described in claim 24 further including:

a second truss cap including a first member having a bottom section and at least one leg section extending generally perpendicular to the bottom section, and wherein the bottom chord member includes a plurality of intermediate members connected in an end-to-end fashion to define a bottom edge of the bottom chord and arranged to provide the bottom edge of the bottom chord member a segmented generally arcuate shape, and wherein the at least one leg section is corrugated to provide the bottom section with a generally smooth arcuate shape similar in radius to the segmented generally arcuate shape of the bottom chord member.

a bottom chord member;

a top chord member extending above the top chord member and fixedly attached thereto.

31. The truss assembly described in claim 30, further including:

at least one lower tie member that extends between the plurality of trusses, and which is fixedly attached to the bottom section of the second truss cap of each truss, wherein each lower tie member extends generally the same distance below the second truss cap.

32. A method for forming a roof supporting system, comprising:

providing a bottom chord member;

providing a top chord member having a top edge, and including a plurality of distinct generally straight portions arranged so as to provide the top edge of the top chord with a segmented generally arcuate shape;

providing a plurality of web members;

fixedly attaching the plurality of web members between the top chord member and the bottom chord member;

providing a truss cap that includes a first member having a top section and at least one leg section extending generally perpendicular to the top section;

corrugating the at least one leg member of the first member, thereby providing the top section of the truss cap with a generally smooth arcuate shape similar in radius to the segmented generally arcuate shape of the top chord, the corrugation defining a frequency, an amplitude and a lateral depth; and fixedly attaching the truss cap to the top chord member such that the truss cap is supported by the top chord member and the top section of the truss cap is upwardly exposed.

33. The method described in claim 30, wherein the corrugation step includes adjusting the frequency of the corrugation along at least one leg member of the truss cap to adjust the of the truss cap.

34. The method described in claim 33, wherein the corrugation step includes adjusting the amplitude of the corrugation along at least one leg member of the truss cap to adjust the radius of the truss cap.

35. The method described in claim 34, wherein the corrugation step includes adjusting the lateral depth of the corrugation within at least one leg member of the truss cap to adjust the radius of the truss cap.

36. The method described in claim 32, wherein the truss cap providing step includes providing a second member having a second top section and a second leg section extending generally perpendicular to the second top section, corrugating the second leg section thereby, providing the second top section with a generally smooth arcuate shape similar to the segmented generally arcuate shape of the top chord, and fixedly attaching the top section of the first member of the truss cap with the second top section of the second member to form an inverted, generally U-shaped channel.

37. The method described in claim 32, wherein the at least one leg of the truss cap providing step includes providing the truss cap with a first leg and a second leg juxtaposed across the top section, thereby forming an inverted generally U-shaped channel.

38. The method described in claim 32, wherein the truss cap providing step includes constructing the truss cap from a lightweight metal.

39. The method described in claim 32, wherein the steps of providing the bottom chord member, the top chord member and the web member, include constructing the bottom chord member, the top chord member and the web members from a lightweight metal.

40. The method described in claim 32, wherein the steps of providing the bottom chord member, the top chord member and the web members include constructing the bottom chord member, the top chord member and the web members from wood.

41. The method described in claim 32, wherein the corrugation step includes adjusting the amplitude of the corrugation along at least one leg member of the truss cap to adjust the radius of the truss cap.

42. The method described in claim 32, wherein the corrugation step includes adjusting the lateral depth of the corrugation within at least one leg member of the truss cap to adjust the radius of the truss cap.

43. A method for forming a roof supporting system, comprising:

providing a bottom chord member having a top edge, and including a plurality of distinct generally straight portions arranged so as to provide the top edge of the top chord with a segmented generally arcuate shape;

providing a plurality of web members;

fixedly attaching the plurality of web members between the top chord member and the bottom chord member;

providing a truss cap that includes a first member having a bottom section and at least one leg section extending generally perpendicular to the top section;

corrugating the at least one leg member of the first member, thereby providing the bottom section of the truss cap with a generally smooth arcuate shape similar in radius to the segmented generally arcuate shape of the bottom chord member, the corrugation defining a frequency, an amplitude and a lateral depth; and fixedly attaching the truss cap to the bottom chord member such that the truss cap is supported by the bottom chord member and the bottom section of the truss cap is downwardly exposed.

44. The method described in claim 43, wherein the corrugation step includes adjusting the frequency of the corrugation along at least one leg member of the truss cap to adjust the of the truss cap.

45. The method described in claim 43, wherein the corrugation step includes adjusting the amplitude of the corrugation along at least one leg member of the truss cap to adjust the radius of the truss cap.

46. The method described in claim 43, wherein the corrugation step includes adjusting the lateral depth of the corrugation within at least one leg member of the truss cap to adjust the radius of the truss cap.

47. The method described in claim 43, wherein the truss cap providing step includes providing a second member having a second bottom section and a second leg section extending generally perpendicular to the second bottom section, corrugating the second leg section thereby, providing the second bottom section with a generally smooth arcuate shape similar to the segmented generally arcuate shape of the bottom chord member, and fixedly attaching the bottom section of the first member of the truss cap with the second bottom section of the second member to form a generally U-shaped channel.

48. The method described in claim 43, wherein the at least one leg of the truss cap providing step includes providing the truss cap with a first leg and a second leg juxtaposed across the bottom section, thereby forming a generally U-shaped channel.

* * * * *